US007962064B2

(12) United States Patent
Asai

(10) Patent No.: US 7,962,064 B2
(45) Date of Patent: Jun. 14, 2011

(54) TONER CONTAINER AND IMAGE FORMING APPARATUS COMPRISING THE SAME

(75) Inventor: Kengo Asai, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/727,002

(22) Filed: Mar. 18, 2010

(65) Prior Publication Data

US 2010/0239325 A1 Sep. 23, 2010

(30) Foreign Application Priority Data

Mar. 19, 2009 (JP) ..... 2009-067596

(51) Int. Cl.
*G03G 15/08* (2006.01)

(52) U.S. Cl. ..... 399/120; 399/12; 399/262

(58) Field of Classification Search ..... 399/12, 399/120, 252, 255, 258–263
See application file for complete search history.

(56) References Cited

U.S. PATENT DOCUMENTS

| | | | | |
|---|---|---|---|---|
| 6,298,208 | B1 * | 10/2001 | Kawamura et al. | 399/262 |
| 7,324,777 | B2 * | 1/2008 | Yamada et al. | 399/258 |
| 2006/0182469 | A1 * | 8/2006 | Koyama et al. | 399/258 |
| 2009/0279921 | A1 * | 11/2009 | Naito et al. | 399/262 |

FOREIGN PATENT DOCUMENTS

| | | |
|---|---|---|
| JP | 2000-214669 | 8/2000 |
| JP | 2000-214689 | 8/2000 |
| JP | 2004-29149 | 1/2004 |
| JP | 2005-301077 | 10/2005 |

OTHER PUBLICATIONS

Japanese Notification of Reason for Refusal mailed Jan. 5, 2011, directed to counterpart Japanese Patent Application No. 2009-067596; 5 pages.

* cited by examiner

*Primary Examiner* — David P Porta
*Assistant Examiner* — Benjamin Schmitt
(74) *Attorney, Agent, or Firm* — Morrison & Foerster LLP

(57) ABSTRACT

A hollow cylindrical cap is rotatably attached to a container body opening provided in one end of a hollow cylindrical container body. A seal member around the container body opening forms a seal between the container body and the cap. Once the cap is attached to the container body, pressing chips are circumferentially slidably engaged with a flange, and the seal member is pressure-sealed to a pressure-seal portion. A toner container identification is contiguous with the rear edge of one of the pressing chips. The toner container identification is formed by denting one part of the cap so its outer surface radially protrudes outward, and has a predetermined cross-section.

10 Claims, 9 Drawing Sheets

TONER CONTAINER AND IMAGE FORMING APPARATUS COMPRISING THE SAME

This application is based on an application No. 2009-067596 filed in Japan, the contents of which are hereby incorporated by reference.

BACKGROUND OF THE INVENTION (1) Field of the Invention

The present invention relates to a toner container that supplies toner to a development unit while being attached to an image forming apparatus such as a photocopier and a printer. The present invention also relates to an image forming apparatus comprising such a toner container.

(2) Description of the Related Art

Generally, in an image forming apparatus such as a photocopier and a printer, a development unit develops an electrostatic latent image formed on a photosensitive drum by using toner. When the toner in the development unit has all been consumed, toner stored in a toner container is supplied to the development unit.

Japanese patent application publication No. 2000-214669 (hereinafter, "Patent Document 1") discloses a toner container composed of a hollow cylindrical body and a hollow cylindrical replenishing portion that includes a toner outlet, the body and the replenishing portion being rotatably connected to each other via a seal member. The toner container can be directly attached to and detached from an image forming apparatus by the user. Once the toner container has been attached to the image forming apparatus, the body is rotated by the drive means included in the image forming apparatus. As a result, toner stored in the body is conveyed toward the replenishing portion due to rotation of a spiral groove formed in the circumferential wall of the body, and supplied to a developing section via a toner outlet.

An image forming apparatus can use only a specific type of toner depending on its model or the like, which varies between different manufacturers. If an image forming apparatus uses a type of toner that is not compatible with itself, the image forming apparatus may not be able to form a toner image in desired image quality. Using a wrong type of toner may also cause mechanical failures, e.g., deprive a development unit of the developing function. The toner container disclosed in Patent Document 1 is not particularly designed with the above problems taken into account.

Some toner containers are used while being directly attached to image forming apparatuses. Typically, such toner containers are configured in such a manner that they can be attached only to certain image forming apparatuses which can compatibly use toners stored in the toner containers. For instance, it has been proposed to configure (i) a toner container including a toner container identification that protrudes outward from the outer surface of the circumferential wall of the toner container, together with (ii) an image forming apparatus including a container identifier, with which the toner container identification latches when attaching the toner container to the image forming apparatus. With the presence of the toner container identification that protrudes outward, such a toner container cannot be attached to an image forming apparatus that does not include a container identifier with which the toner container identification can latch. This method can prevent an image forming apparatus from using a type of toner that is not compatible with the image forming apparatus.

However, as the toner container identification of the toner container protrudes outward, there is a possibility that the toner container identification may be partially or entirely removed. If the toner container identification is partially or entirely removed, the toner container could be attached to an image forming apparatus to which it is not supposed to be attached, with the result that this image forming apparatus has to use a type of toner that is not compatible with itself. This may cause mechanical failures in the development unit and the like.

SUMMARY OF THE INVENTION

A main aspect of the present invention is a toner container comprising: a hollow cylindrical container body that has a container body opening in one end thereof and stores toner therein; a hollow cylindrical cap that has a cap opening in one end thereof and is rotatably engaged with the container body by the one end of the container body being inserted into the cap opening; and a ring-shaped seal member that is disposed along an outer circumference of the container body opening and forms a seal between the container body and the cap. Here, (i) the cap includes: a pressure-seal portion to which the seal member is to be pressure-sealed, the pressure-seal portion being disposed inside the cap; one or more pressing chips that (a) are respectively formed in different areas of a circumferential wall of the cap and (b) due to the cap being engaged with the container body, latch with the container body in such a manner that a front edge of each of the pressing chips applies pressure to the container body to cause the seal member to be pressure-sealed to the pressure-seal portion, the front edge of each of the pressing chips being closer to the other end of the cap than any other edge thereof is, and being slidable across the container body in a circumferential direction; and a toner container identification that is formed by denting one part of the circumferential wall of the cap, which is contiguous with a rear edge of one of the pressing chips, in such a manner that (a) an outer surface of the toner container identification radially protrudes further outward than an outer surface of the other part of the circumferential wall of the cap, and (b) the toner container identification has a predetermined cross-section, the rear edge of the one of the pressing chips being an opposite edge of the front edge thereof, and (ii) the toner container identification is integrated with the one of the pressing chips so that, when the toner container identification is removed from the circumferential wall of the cap, the one of the pressing chips is removed as well.

Another aspect of the present invention is an image forming apparatus comprising: a photosensitive part on which an electrostatic latent image is formed; a development part operable to develop the electrostatic latent image formed on the photosensitive part by using toner; and the above-described toner container, operable to supply the toner to the development part.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

A toner container identification having a predetermined cross-section is formed in the above-described toner container of the present invention. Therefore, the above-described toner container cannot be attached to an image forming apparatus that does not include a member into which such a toner container identification can be inserted. In other words, the above-described toner container can be applied to and used in only an image forming apparatus that is compatible with a type of toner stored in a container body of the above-described toner container.

Furthermore, according to the present invention, the toner container identification is integrally joined to one of pressing chips that cause a seal member to be pressure-sealed to a pressure-seal portion of a cap, so that when the toner container identification is removed, said one of pressing chips is removed as well. Removal of said one of pressing chips hinders the seal member from being pressure-sealed to the pressure-seal portion of the cap, causing the toner in the container body to leak to the outside. Such a toner container cannot be attached to and used in an image forming apparatus. The present invention can therefore prevent mechanical failures of a development unit and other structural components.

A second aspect of the present invention is the toner container pertaining to the main aspect, preferably structured in such a way that (i) the cap further includes, in the circumferential wall thereof: one or more openings that are respectively adjacent to the front edges of the pressing chips; and one or more pairs of cut grooves that each extend from a corresponding one of the openings in a direction of a rotational axis of the cap, so that each of the pressing chips is adjacent to a corresponding one of the pairs of cut grooves at side edges thereof that are in parallel with the rotational direction, and (ii) the one of the pressing chips is directly surrounded by the toner container identification and one of the pairs of cut grooves.

A third aspect of the present invention is the toner container pertaining to the second aspect, preferably structured in such a way that a width of the toner container identification in the circumferential direction is greater than a width of the one of the pressing chips in the circumferential direction.

A fourth aspect of the present invention is the toner container pertaining to the major aspect, preferably structured in such a way that the toner container identification is formed as a dent on an inner surface of the circumferential wall of the cap, the dent extending in a direction of a rotational axis of the cap.

A fifth aspect of the present invention is the toner container pertaining to the major aspect, preferably structured in such a way that one edge of the toner container identification reaches an entrance of the cap opening.

A description is now given of an embodiment of the present invention.

Figure 1:
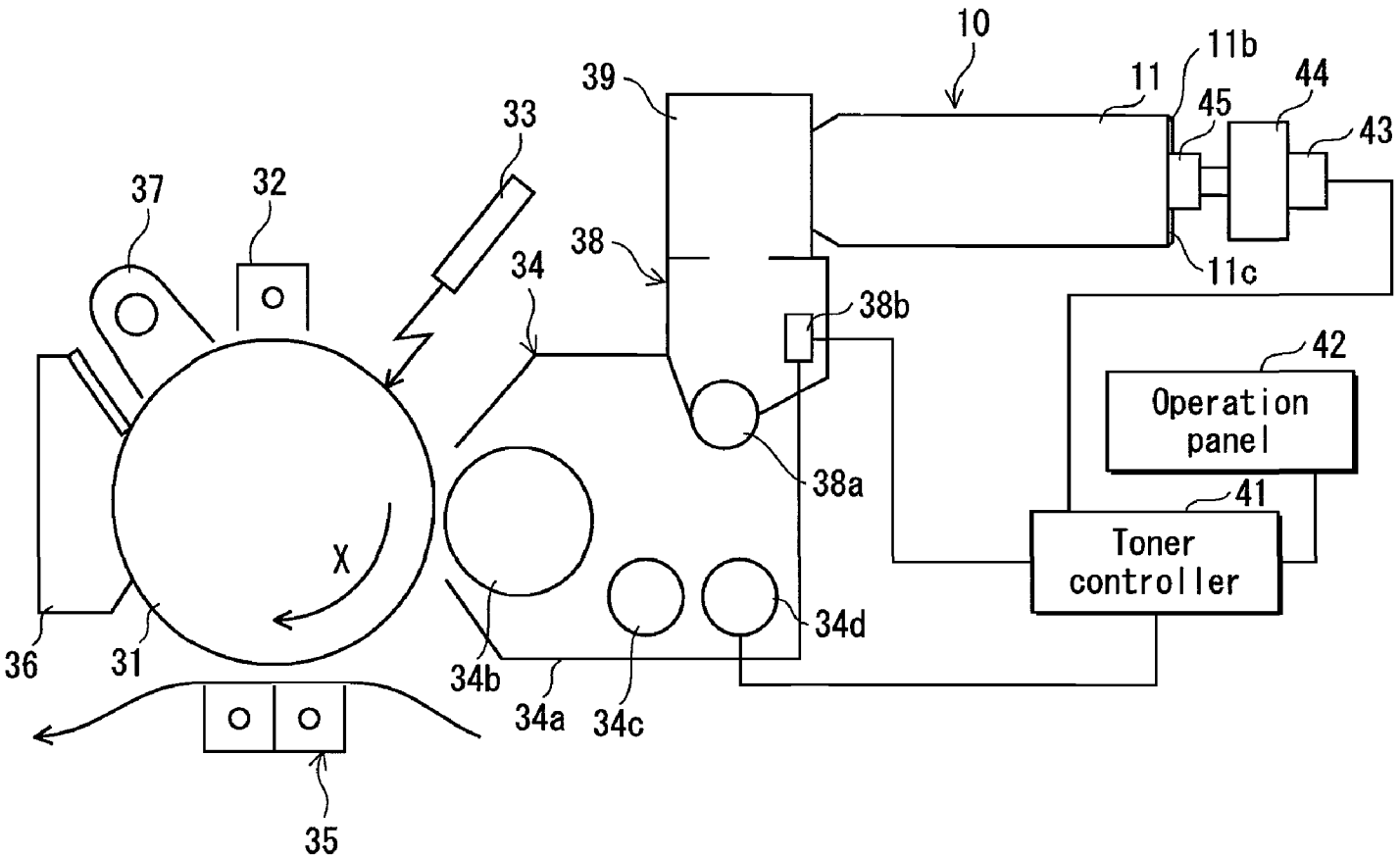
FIG. 1 is a schematic diagram showing the structures of major components of an image forming apparatus, to which a toner container pertaining to the embodiment of the present invention has been attached.

FIG. 1 is a schematic diagram showing the structures of major components of an image forming apparatus, to which a toner container pertaining to the present embodiment has been attached. The image forming apparatus comprises a photosensitive drum 31 that rotates in the direction of arrow X shown in FIG. 1, and a charger 32 that is located above the photosensitive drum 31 and evenly charges the surface of the photosensitive drum 31. In the rotational direction of the photosensitive drum 31, a print head (PH) 33 is disposed downstream relative to the charger 32. By the photosensitive drum 31 being exposed to the laser light emitted from the print head 33, an electrostatic latent image is formed on the surface of the photosensitive drum 31 which has been evenly charged by the charger 32. In the rotational direction of the photosensitive drum 31, a development unit 34 is disposed downstream relative to the print head 33. The development unit 34 develops the electrostatic latent image formed on the surface of the photosensitive drum 31 by using toner.

A transfer/separation charger 35 is located underneath the photosensitive drum 31. The transfer/separation charger 35 transfers a toner image formed on the surface of the photosensitive drum 31 onto a recording sheet, and separates the recording sheet from the photosensitive drum 31. The recording sheet, which is carried along the rotational direction of the photosensitive drum 31, passes between the photosensitive drum 31 and the transfer/separation charger 35.

The recording sheet is carried in synchronization with the rotation of the photosensitive drum 31, so it comes in contact with the toner image formed on the photosensitive drum 31. The transfer/separation charger 35 transfers the toner image formed on the photosensitive drum 31 onto the recording sheet, and then separates the recording sheet, onto which the toner image has been transferred, from the photosensitive drum 31. After the recording sheet has been separated from the photosensitive drum 31, it is carried to a fixing device (not illustrated). In the fixing device, the toner image on the recording sheet is fixed to the recording sheet. Once the toner image formed on the surface of the photosensitive drum 31 has been transferred onto the recording sheet, the surface of the photosensitive drum 31 is cleaned by a cleaning device 36, and the charge applied to the photosensitive drum 31 is removed by a charge-removal device 37.

The development unit 34 includes a housing 34*a* that has an opening facing the photosensitive drum 31. The housing 34*a* contains (i) a development roller 34*b* that is disposed in parallel with the photosensitive drum 31 while facing the photosensitive drum 31 via the opening of the housing 34*a*, and (ii) a pair of agitator screws 34*c* and 34*d* that are disposed in parallel with the development roller 34*b*, and agitate and convey developer in the housing 34*a* toward the opposite directions. Above the housing 34*a* is mounted a toner hopper 38 that supplies toner to the housing 34*a*. A container holder 39 is mounted on top of the toner hopper 38. Once the toner container 10 pertaining to the embodiment of the present invention is attached to the container holder 39, the container holder 39 horizontally holds/supports the toner container 10.

A toner supply screw 38*a* is provided in the bottom tip of the toner hopper 38 in parallel with the development roller 34*b*. The toner supply screw 38*a* supplies toner in the toner hopper 38 to the housing 34*a* of the development unit 34. A toner level sensor 38*b* is also provided inside the toner hopper 38. The toner level sensor 38*b* detects the amount of toner left in the toner hopper 38 (hereinafter, "toner level"), and transmits a signal indicating the detected toner level to a toner controller 41.

An insertion space is provided inside the container holder 39 mounted on top of the toner hopper 38. The first end of the toner container 10 is to be inserted into the insertion space with the toner container 10 maintaining its horizontal posture. Once the first end of the toner container 10 is inserted into the insertion space, the toner container 10 is horizontally held/supported by the container holder 39. A latching protrusion 11*c* is mounted on a bottom wall 11*b* in the second end of the toner container 10, which is horizontally held/supported by the container holder 39. A latching pawl 45, which is joined to a toner supply motor 43 via a speed reducer 44, is to latch with the latching protrusion 11*c*.

The toner supply motor 43 is controlled by the toner controller 41 according to the result of the detection performed by the toner level sensor 38*b*. When the toner level sensor 38*b* has detected that the toner level of the toner in the toner hopper 38 is equal to or smaller than a predetermined level, the toner controller 41 drives the toner supply motor 43 to make the toner supply motor 43 rotate. This causes rotation of a container body 11 of the toner container 10, which stores toner therein. The toner in the container body 11 is supplied to the toner hopper 38 by the toner supply motor 43 rotating the container body 11.

The toner that has been supplied to the toner hopper 38 is further supplied to the housing 34*a* of the development unit 34 by the toner supply screw 38*a*. The toner that has been supplied to the housing 34*a* is agitated and conveyed toward the development roller 34*b* by the pair of agitator screws 34*c* and 34*d*. The development roller 34*b* develops the electric latent image formed on the surface of the photosensitive drum 31 by using the toner.

As described earlier, the toner controller 41 controls the toner supplymotor 43 according to the result of the detection performed by the toner level sensor 38*b*. In addition to this, the toner controller 41 also has the function of displaying a predetermined warning on a display of an operation panel when the toner level of the toner in the toner hopper 38, which is detected by the toner level sensor 38*b*, does not increase after the toner supply motor 43 has been rotated for a predetermined time period.

Figure 2:
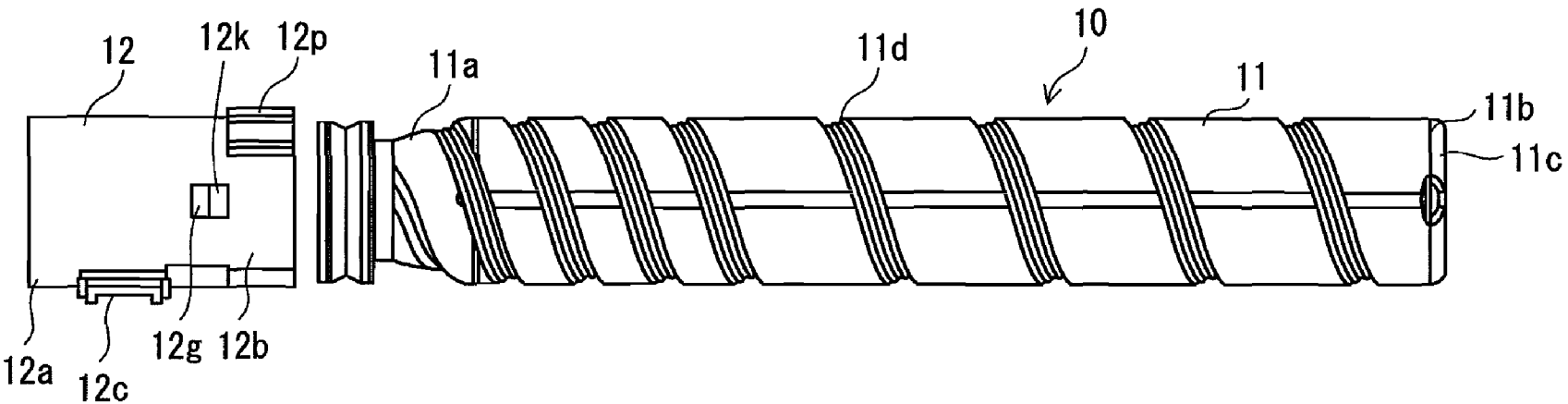
FIG. 2 is a side view of the toner container pertaining to the embodiment of the present invention, the toner container being in a state where a cap has been detached from a container body.

FIG. 2 is a side view of the toner container 10 pertaining to the present embodiment. The toner container 10 is composed of (i) a hollow cylindrical container body 11 storing therein toner having certain properties, etc., and (ii) a hollow cylindrical cap 12 attached to the first end of the container body 11. It should be noted that the toner container 10 shown in FIG. 2 is in a state where the cap 12 has been detached from the container body 11.

Figure 3:
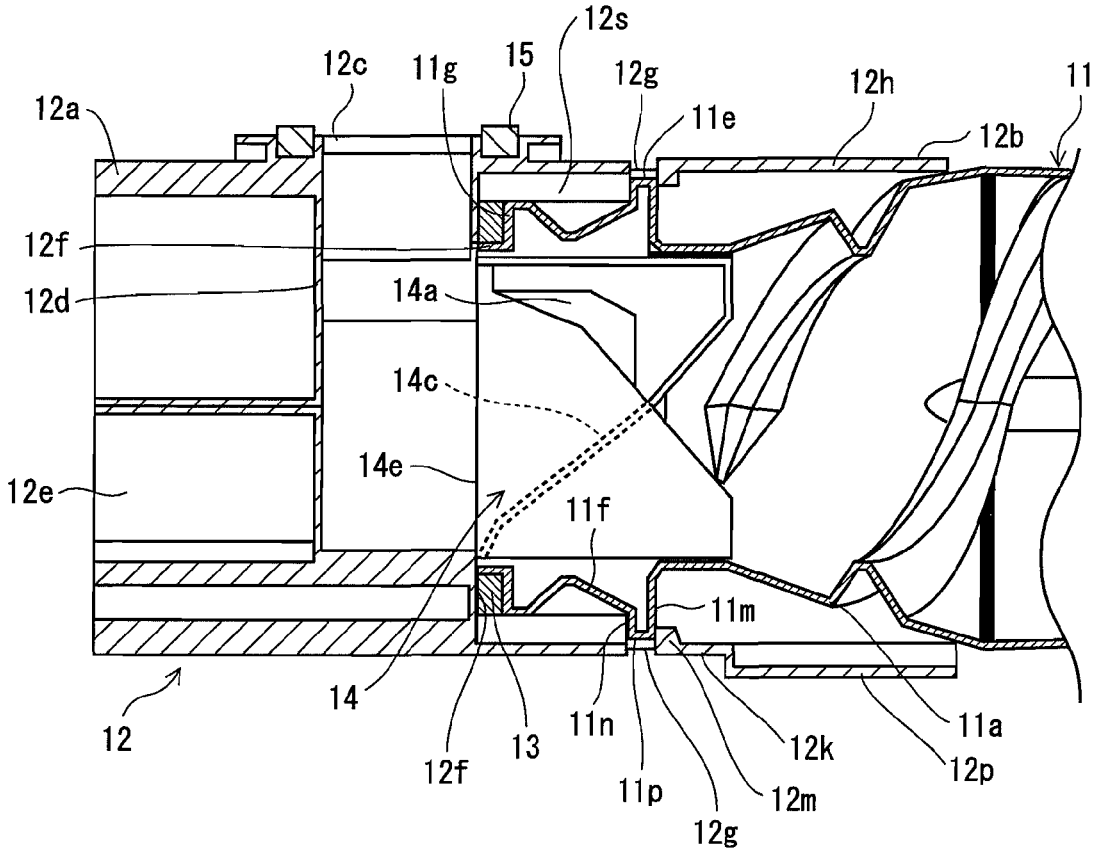
FIG. 3 is a vertical cross-sectional view of a part of the toner container where the cap has been attached to the tip of the first end of the container body.
Figure 4:
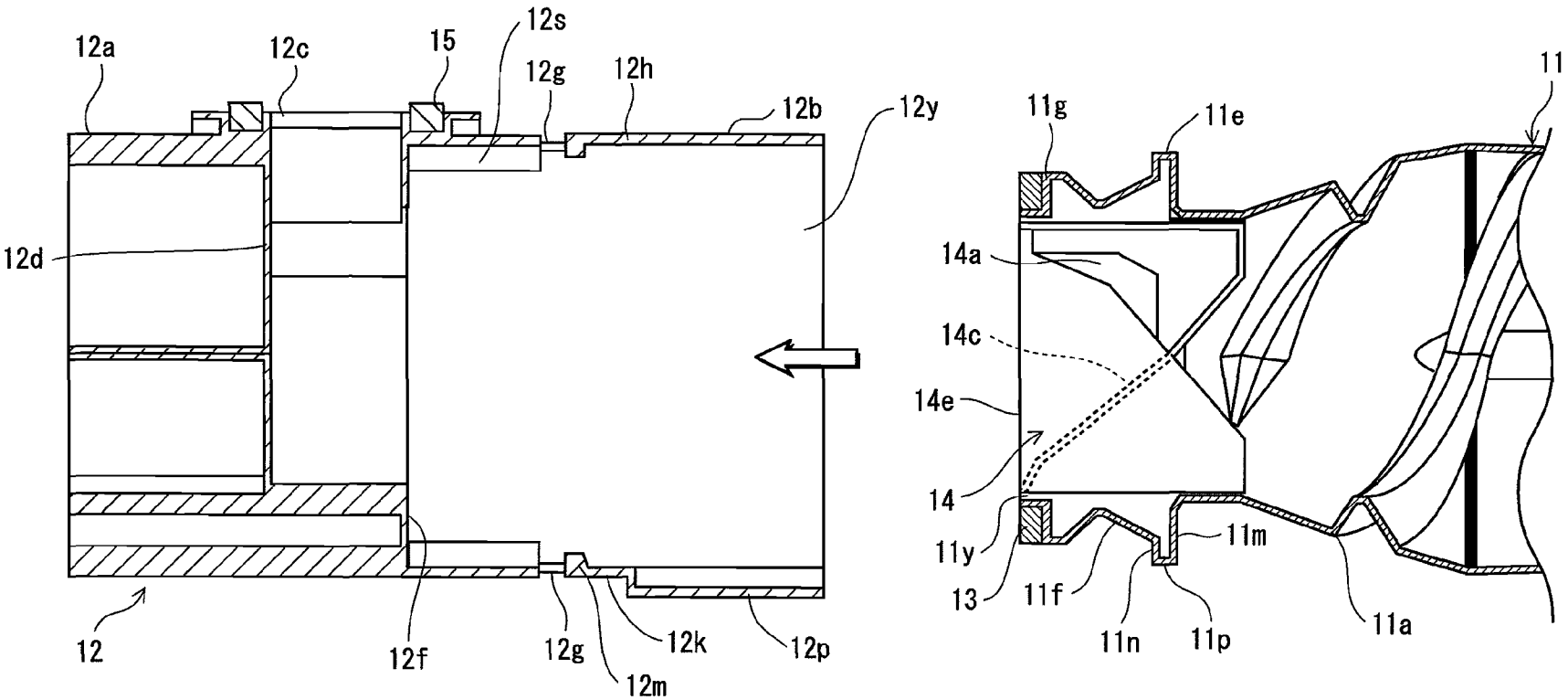
FIG. 4 is a cross-sectional view of a part of the toner container in a state where the cap has been detached from the container body.

FIG. 3 is a vertical cross-sectional view of a part of the toner container 10 where the cap 12 has been attached to the first end of the container body 11. FIG. 4 is a cross-sectional view of a part of the toner container 10 where the cap 12 has been detached from the container body 11.

A toner guiding member 11*a* is formed in the first end of the container body 11 to which the cap 12 is to be attached. The toner guiding member 11*a* is tapered in shape. More specifically, the diameter of the toner guiding member 11*a* gradually reduces toward the tip of the first end of the container body 11. A container body opening fly is provided in the tip of the first end of the container body 11 (see FIG. 4). The container body 11 has a bottom wall 11*b* in the second end thereof, the second end being the opposite side of the toner guiding member 11*a* in the direction of a rotational axis of the toner container 10 (hereinafter, simply "rotational axis"). The above-described latching protrusion 11*c* is mounted on the outer surface of the bottom wall 11*b*.

A cap opening 12*y* is provided in the tip of the second end of the hollow cylindrical cap 12 (see FIG. 4). The tip of the first end of the container body 11, in which the container body opening 11*y* is provided, is to be inserted into the cap opening 12*y*. Once the tip of the first end of the container body 11 is inserted into the cap opening 12*y* and engages with the cap 12, the cap 12 is attached to the container body 11 in such a manner that they are rotatable around the same rotational axis.

An agitator groove 11*d* is formed in substantially the entire circumferential wall of the container body 11. When viewed from the outside of the container body 11, the agitator groove 11*d* is dented or concave in shape; that is, the agitator groove 11*d* protrudes toward the inside of the container body 11. The agitator groove 11*d* is continuously formed to have a spiral shape, from the bottom wall 11*b* through the toner guiding member 11*a*. While the container body 11 is being rotated by the toner supply motor 43, the agitator groove 11*d* conveys toner in the container body 11 from the bottom wall 11*b* toward the toner guiding member 11*a*. In the direction of the rotational axis, the distance between adjacent points of the agitator groove 11*d* is longer in the vicinity of the bottom wall 11*b*, and shorter in the vicinity of the toner guiding member 11*a*.

A flange 11*e* is provided contiguous with the edge of the toner guiding member 11*a* of the container body 11. The flange 11*e* protrudes toward the outside in the direction perpendicular to the rotational axis. The flange 11*e* is composed of (i) a first flat wall 11*m* that extends from the edge of the toner guiding member 11*a* toward the outside in the direction perpendicular to the rotational axis, (ii) a hollow cylindrical outer circumferential wall 11*p* that is contiguous with the first flat wall 11*m* and extends toward the tip of the first end of the container body 11, and (iii) a second flat wall 11*n* that extends from the edge of the outer circumferential wall 11*p* toward the inside of the container body 11 in the direction perpendicular to the rotational axis. In the direction of a diameter of the container body 11, the length of the second flat wall 11*n* is shorter than the length of the first flat wall 11*m*.

A stretchable member 11*f* extends from the edge of the second flat wall 11*n* of the flange 11*e* toward the tip of the first end of the container body 11. The stretchable member 11*f* can be extended or compressed in the direction of the rotational axis, and is composed of a first slope and a second slope. The first slope is slanted in such a manner that the diameter of the container body 11 gradually reduces from the boundary between the second flat wall 11*n* and the first slope to the boundary between the first and second slopes. The second slope is slanted in such a manner that the diameter of the container body 11 gradually increases from the boundary between the first and second slopes to an edge of the second slope that is closest to the tip of the first end of the container body 11. The stretchable member 11*f* can be extended or compressed along the rotational axis by each of the first and second slopes changing its angle of incline.

A seal attachment member 11*g* is joined to said edge of the second slope of the stretchable potion 11*f*. A ring-shaped seal member 13 is to be attached to the seal attachment member 11*g*. The seal attachment member 11*g* is composed of (i) a flat seal attachment wall that extends from said edge of the second slope of the stretchable member 11*f* toward the inside of the container body 11 in the direction perpendicular to the rotational axis, and (ii) a seal engaging wall that extends from an edge of the seal attachment wall toward the tip of the first end of the container body 11, said edge of the seal attachment wall being closest to the inside of the container body 11. More specifically, the seal attachment member 11*g* is L-shaped in the cross-section. The ring-shaped seal member 13 is to engage with the seal engaging wall while being tightly attached to the seal attachment wall.

Figure 5:
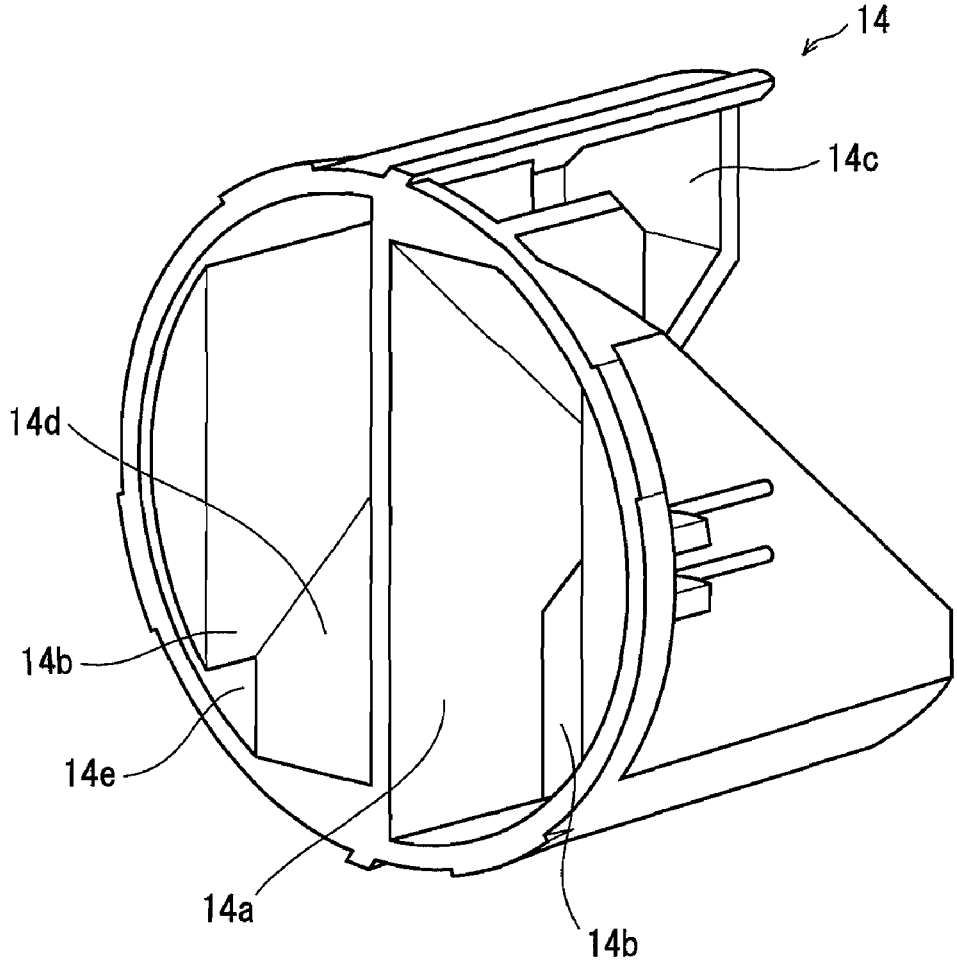
FIG. 5 is a perspective view of a toner adjustor provided inside the container body of the toner container.

A toner adjustor 14 is provided inside the tip of the first end of the container body 11. The toner adjustor 14 adjusts the amount of toner flowing toward the cap 12 due to the rotation of the toner container 11. FIG. 5 is a perspective view of the toner adjustor 14. The toner adjustor 14, which has a hollow cylindrical shape, has been inserted inside the tip of the first end of the container body 11 so that it rotates in coordination with the container body 11.

The internal space of the toner adjustor 14 is divided into two toner flow sections 14*b* by a partition wall 14*a*. The toner flow sections 14*b* have the same structure, but one of them is flipped upside down by 180 degrees with respect to the other one. Toner flows into each of the toner flow sections 14*b* from a toner inlet 14*c*, which is provided in the vicinity of the rear end of the toner adjustor 14 that is closer to the second end of the container body 11 than the front end thereof is. Due to the rotation of the toner adjustor 14 in coordination with the container body 11, the toner that has flown into the toner flow sections 14*b* is conveyed along slanted surfaces 14*d* of the toner flow sections 14*b*, and further flows into the cap 12 via a toner outlet 14*e*. The toner that has flown into the cap 12 is dispensed from a toner dispensing outlet 12*c* formed in the circumferential wall of the cap 12 (see FIGS. 3 and 4).

The cap 12 is formed in a hollow cylindrical shape to have an outer diameter substantially the same as the outer diameter of the container body 11. There is a spatial opening in the tip of the first end of the cap 12, the spatial opening connecting to the outside of the cap 12. In the direction of the rotational axis, the first end of the cap 12 is on the opposite side of the cap opening 12*y* into which the container body 11 is inserted. The circumferential wall of the cap 12 is roughly divided into (i) a thin wall portion 12*b* around the cap opening 12*y*, and (ii) a thick wall portion 12*a* around the first end of the cap 12. The inner diameter of the cap 12 is smaller in the thick wall portion 12*a* than in the thin wall portion 12*b*.

The thin wall portion 12*b* is attached to the container body 11 with the edge of the toner guiding member 11*a*, the flange 11*e*, the stretchable member 11*f* and the seal attachment member 11*g* enclosed therewithin (note, the flange 11*e*, the stretchable member 11*f* and the seal attachment member 11*g* are all provided directly or indirectly contiguous with the edge of the toner guiding member 11*a*).

The thick wall portion 12*a* includes a partition wall 12*d* around the center thereof in the direction of the rotational axis, the partition wall 12*d* being perpendicular to the rotational axis (see FIG. 3). The toner dispensing outlet 12*c* is formed in a certain area of the thick wall portion 12*a*. The toner dispensing outlet 12*c* has a rectangular shape, opens to the outside of the cap 12, and is located on one side of the partition wall 12*d* that is closer to the thin wall portion 12*b* than the other side thereof is. A portion of the partition wall 12*d* serves as a front wall of the toner dispensing outlet 12*c*, the front wall being closer to the first end of the cap 12 than any other wall of the toner dispensing outlet 12*c*.

Figure 6:
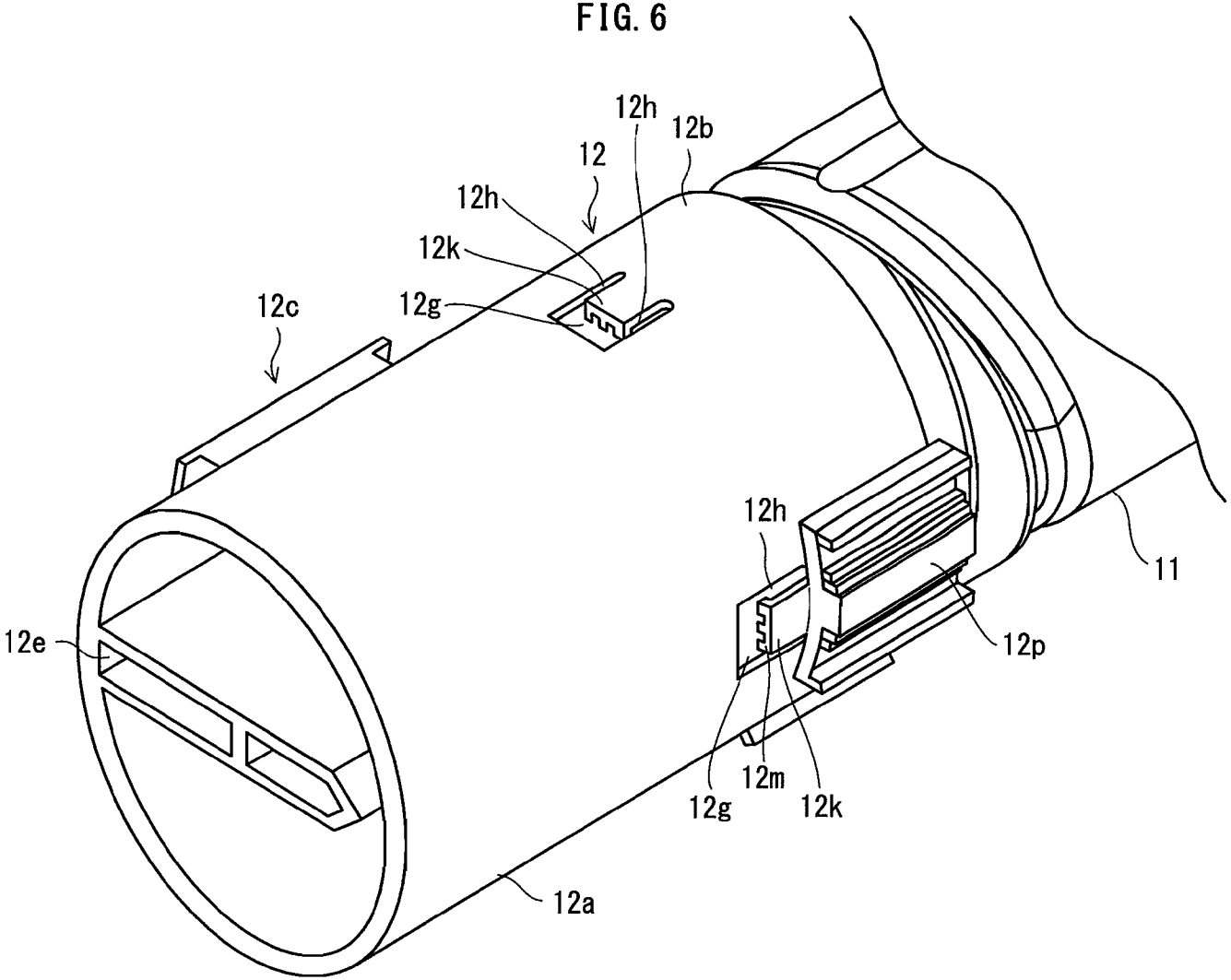
FIG. 6 is a perspective view of the cap that has been attached to the container body of the toner container.
Figure 7:
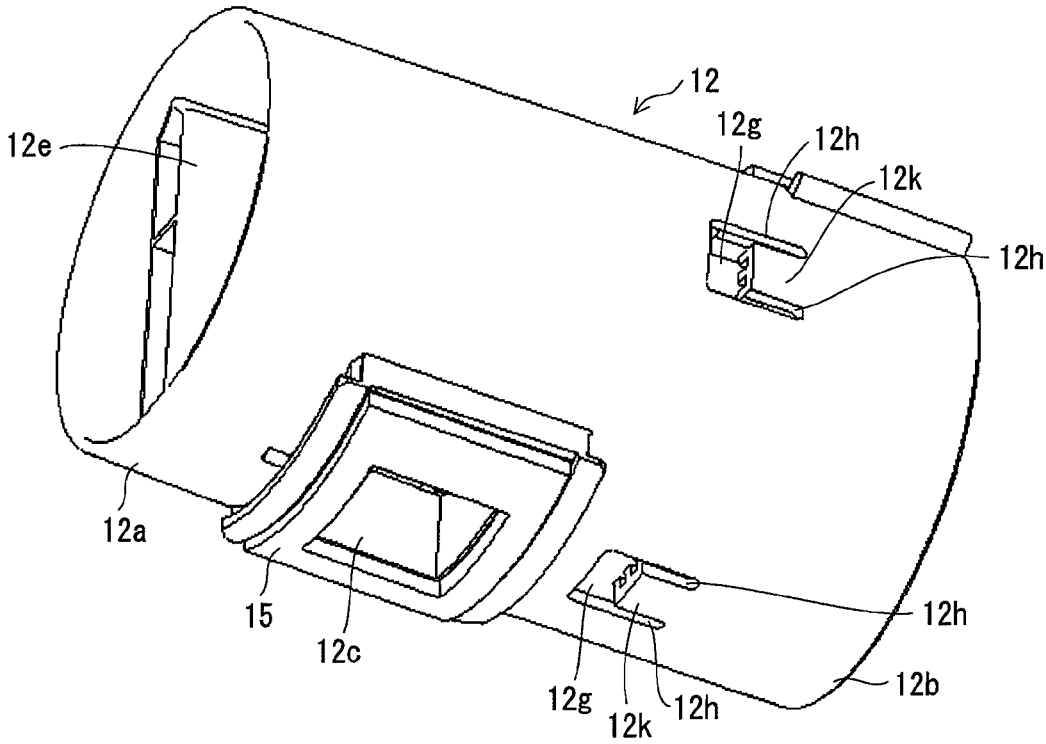
FIG. 7 is a perspective view of the exterior of the cap of the toner container, the cap having been detached from the container body.
Figure 8:
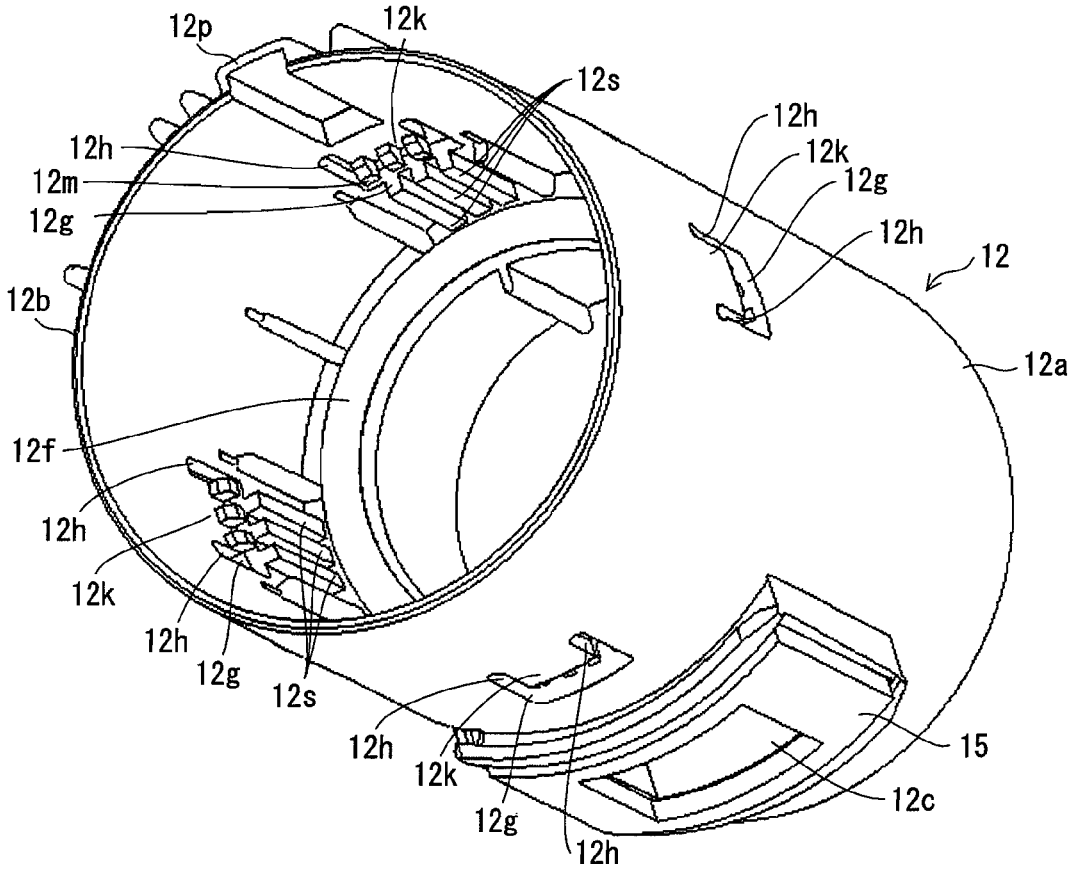
FIG. 8 is a perspective view of the cap of the toner container that has been detached from the container body, as viewed from the side facing the container body.

FIG. 6 is a perspective view of the cap 12 that has been attached to the container body 11. FIG. 7 is a perspective view of the exterior of the cap 12 that has been detached from the container body 11. FIG. 8 is a perspective view of the cap 12 that has been detached from the container body 11, as viewed from the side facing the container body 11. As shown in FIGS. 3, 4, 7 and 8, a rectangular, frame-shaped dispensing outlet seal member 15 is provided on the outer surface of the thick wall portion 12*a*, in such a manner that the dispensing outlet seal member 15 borders around the toner dispensing outlet 12*c*. A shutter (not illustrated) is also provided facing the outer surface of the dispensing outlet seal member 15. This shutter opens/closes the toner dispensing outlet 12*c* as it slides over the dispensing outlet seal member 15. When the toner container 10 is not attached to the image forming apparatus, the shutter seals the toner dispensing outlet 12*c* airtight via the dispensing outlet seal member 15.

As shown in FIGS. 3 to 8, a rotational protrusion 12*e* for rotating the cap 12 is provided inside the thick wall portion 12*a*. The rotational protrusion 12*e* protrudes/extends from the partition wall 12*d* toward the first end of the cap 12, in which the spatial opening is provided. The rotational protrusion 12*e* roughly represents a continuum of a diameter of the partition wall 12*d*. The rotational protrusion 12*e* receives a rotational force derived from rotation of another entity, such as (i) rotation of a cap rotation mechanism (not illustrated), which is mounted in the image forming apparatus and can latch with the rotational protrusion 12*e*, and (ii) rotation of the toner container 10, which is manually caused by the user. This rotational force makes the cap 12 rotate around the rotational axis by a predetermined degree. When the rotational protrusion 12*e* receives this rotational force with the shutter fixed in position, the toner dispensing outlet 12*c* slides off the shutter and opens to the outside of the cap 12, facing downward.

As shown in FIGS. 3 and 8, a pressure-seal portion 12*f* is mounted on the inner surface of the thick wall portion 12*a* in a full circumference, in such a manner that the pressure-seal portion 12*f* protrudes toward the inside of the cap 12 in the direction perpendicular to the rotational axis. The pressure-seal portion 12*f* is in a position where it faces the seal member 13 attached to the tip of the first end of the container body 11, which is to be inserted inside the thick wall portion 12*a*. A portion of the pressure-seal portion 12*f* serves as a rear wall of the toner dispensing outlet 12*c*, the rear wall being closer to the thin wall portion 12*b* than the front wall of the toner dispensing outlet 12*c* is.

As shown in FIGS. 3 to 8, four openings 12*g* are formed in the thin wall portion 12*b*. The four openings 12*g* are distanced from one another at a predetermined interval in the circumferential direction. By the cap 12 being attached to the container body 11, each of the four openings 12*g* opposes the outer circumferential wall 11*p* in the flange 11*e* of the container body 11. One of the four openings 12*g* is located to maintain a certain distance from the toner dispensing outlet 12*c* in the direction of the rotational axis. The thin wall portion 12*b* has cut grooves 12*h*, which are (i) continua of two sides of each opening 12*g* that are in parallel with the rotational axis, and (ii) axially extend toward the second end of the cap 12 into which the container body 11 is to be inserted. Pressing chips 12*k* are also formed in the thin wall portion 12*b*, so that each pressing chip 12*k* is adjacent to each pair of cut grooves 12*h* at side edges thereof that are in parallel with the rotational axis. Each pressing chip 12*k* presses the flange 11*e* toward the first end of the cap 12. A set of three pressing members 12*m* is formed along a front edge of each pressing chip 12*k*, the front edge being adjacent to a corresponding one of the openings 12*g*. Each set of three pressing members 12*m* protrudes toward the inside of the cap 12, so as to slidably come in contact with the first flat wall 11*m* in the flange 11*e*.

As shown in FIG. 8, sets of three ribs 12*s* that extend in the direction of the rotational axis are provided in certain areas of the inner surface of the thin wall portion 12*b*. Each of these certain areas is on the opposite side of the corresponding opening 12*g* from the corresponding pressing chip 12*k*. Rear surfaces of the ribs 12*s*, which are most adjacent to the openings 12*g* of all surfaces of the ribs 12*s*, come in contact with the second flat wall 11*n* in the flange 11*e* pressed by the pressing chips 12*k*. Front surfaces of the ribs 12*s*, which are opposite surfaces of the rear surfaces of the ribs 12*s* in the rotational direction, reach the step formed at the boundary between the thin wall portion 12*b* and the thick wall portion 12*a*.

As shown in FIG. 6, a toner container identification 12*p* is formed in the thin wall portion 12*b*, in such a manner that the toner container identification 12*p* is contiguous with one of the pressing chips 12*k* and is closer to the second end of the cap 12, into which the container body 11 is to be inserted, than said one of the pressing chips 12*k* is. Said one of the pressing chips 12*k*, with which the toner container identification 12*p* is contiguous, is adjacent to one of the openings 12*g* that is on the opposite side of the rotational axis from another one of the pressing openings 12*g* which axially neighbors the toner dispensing outlet 12*c*.

The toner container identification 12*p* is formed by denting one part of the thin wall portion 12*b* so that the outer surface of the toner container identification 12*p* radially protrudes further toward the outside as compared to the outer surface of the other part of the thin wall portion 12*b*. The toner container identification 12*p* is formed as a dent on the inner surface of the thin wall portion 12*b*, the dent axially extending toward an entrance of the cap opening 12*y* into which the container body 11 is to be inserted. In the direction perpendicular to the rotational axis, the outer surface of the toner container identification 12*p* is taller than the outer surface of the other part of the thin wall portion 12*b* by a length substantially equal to the wall thickness of the other part of the thin wall portion 12*b*.

A front edge of the toner container identification 12*p* is integrally joined to said one of the pressing chips 12*k*. A rear edge of the toner container identification 12*p* reaches the entrance of the cap opening 12*y*, into which the container body 11 is to be inserted (see FIGS. 3 and 4). In the circumferential direction, the width of the toner container identification 12*p*, whose outer surface radially protrudes further toward the outside as compared to the outer surface of the other part of the thin wall portion 12*b*, is greater than the width of said one of the pressing chips 12*k*. Put another way, said one of the pressing chips 12*k* is connected only with the toner container identification 12*p*, which has been formed by denting said one part of the thin wall portion 12*b* so that the outer surface of the toner container identification 12*p* radially protrudes toward the outside.

According to the above-described toner container 10, one toner having certain properties is stored into the container body 11, the cap 12 is attached to the container body 11. Here, the seal member 13 has been attached to the seal attachment member 11*g* provided in the vicinity of the tip of the first end of the container body 11. The container body opening 11*y* of the container body 11, in which the seal member 13 has been attached, is inserted into the thin wall portion 12*b* via the cap opening 12*y* of the cap 12. Once the seal member 13 has been pressure-sealed to the pressure-seal portion 12*f* mounted within the thick wall portion 12*a*, the container body opening 11*y* of the container body 11 is further pushed into the cap 12 so that the seal member 13 is pressure-sealed to the pressure-seal portion 12*f* more tightly.

As a result, the stretchable member 11*f* provided in the vicinity of the tip of the first end of the container body 11 becomes compressed, and the outer circumferential wall lip in the flange 11*e*, which has been inserted into the cap 12, opposes the openings 12*g*. At this point, the first flat wall 11*m* in the flange 11*e*, which is adjacent to the outer circumferential wall 11*p* and is closer to the toner guiding member 11*a* than the outer circumferential wall 11*p* is, is pressed by each of the pressing members 12*m* of the pressing chips 12*k* provided in the thin wall portion 12*b* of the cap 12.

By the pressing members 12*m* of the pressing chips 12*k* pressing the first flat wall 11*m* in the flange 11*e*, the seal member 13 provided in the tip of the first end of the container body 11 is tightly pressure-sealed to the pressure-seal portion 12*f* of the cap 12 with the aid of the compressed stretchable member 11*f*. Once the seal member 13 has been pressure-sealed to the pressure-seal portion 12*f* in the above manner, the cap 12 is attached to the container body 11. At this time, the seal member 13 forms a seal between the container body 11 and the cap 12 so that the toner in the container body 11 does not leak to the outside. It should be noted here that the first flat wall 11*m* in the flange 11*e* is merely pressed by the pressing members 12*m* of the pressing chips 12*k*. Therefore, the first flat wall 11*m* and each of the pressing members 12*m* are slidable across each other in the circumferential direction.

The toner container 10 of the present embodiment is used while being attached to the container holder 39 mounted on top of the toner hopper 38 included in the image forming apparatus shown in FIG. 1. A container identifier is provided at an entrance of the insertion space of the container holder 39, into which the cap 12 is to be inserted. The toner container identification 12*p* is to pass over the container identifier. The container identifier includes a container passage. The toner container identification 12*p* and the container passage have complementary shapes in the cross-sections thereof. When the cap 12 is inserted into the insertion space provided inside the container holder 39, the toner container identification 12*p* passes over the container identifier. Once the cap 12 is housed within the container holder 39, an entirety of the toner container 10 is horizontally held/supported by the container holder 39.

The image forming apparatus also includes a shutter latching member in which an open space is provided. The open space in the shutter latching member and the shutter for opening/closing the toner dispensing outlet 12*c* have complementary shapes in the cross-sections thereof, so that the shutter can be recessed into the open space in the shutter latching member. The shutter latching member is fixed in place to the image forming apparatus. The cap 12 is structured so that it can be rotated by, for example, 60 degrees while being held/supported by the container holder 39.

The toner container 10 of the present embodiment can be attached to the above-described container holder 39, because the toner container identification 12*p*, which is to pass over the container identifier of the container holder 39, is formed in the cap 12. However, certain types of toner containers that are different from the toner container 10 of the present embodiment cannot be attached to the container holder 39. One example of said certain types of toner containers is a toner container having a toner container identification that is not complementary in shape with the container passage of the container identifier, such as a toner container identification that radially protrudes further toward the outside as compared to the toner container identification 12*p*, and a toner container identification whose width in the circumferential direction is greater than the width of the toner container identification 12*p* in the circumferential direction.

When attaching the toner container 10 of the present embodiment to the container holder 39 of the image forming apparatus that can compatibly use toner stored in the container body 11, the toner container 10 is inserted into the insertion space of the container holder 39 with its horizontal posture maintained, so that the toner container identification 12*p* passes over the container identifier. Consequently, the cap 12 is inserted into the container holder 39.

Thereafter, with the shutter (provided in the cap 12) latched with the shutter latching member, the user grips the rotational protrusion 12*e* to manually rotate the cap 12 by, for example, 60 degrees. Due to the shutter being fixed in place by the shutter latching member, the above rotation operation opens the toner dispensing outlet 12*c* of the cap 12 while the toner dispensing outlet 12*c* is facing downward.

If the image forming apparatus includes a rotation mechanism that latches with the rotational protrusion 12*e* of the cap 12 to rotate the cap 12, the cap 12 may be rotated by this rotation mechanism instead.

Once the cap 12 is rotated, the latching protrusion 11*c* mounted on the bottom wall 11*b* of the container body 11 latches with the latching pawl 45 of the image forming apparatus. Consequently, the container body 11 is joined to the toner supply motor 43. Subsequently, the toner supply motor 43 is driven and rotated. At this time, only the container body 11 is rotated, since the cap 12 is firmly held/supported by the container holder 39. The toner in the container body 11 is conveyed toward the container body opening 11*y*, which is provided in the tip of the first end of the container body 11, by the agitator groove 11*d* formed in the circumferential wall of the container body 11. The toner in the container body 11 then flows into the cap 12 via the toner adjustor 14. Once the toner flows into the cap 12, the toner is supplied to the toner hopper 38 via the toner dispensing outlet 12*c*.

If the user attempts to attach the above-described toner container 10 to, for instance, an image forming apparatus that cannot compatibly use the toner stored in the container body 11, the user will fail to attach the toner container 10 to such an image forming apparatus. This is because a container holder 39 of such an image forming apparatus does not include a container identifier over which the toner container identification 12*p* is to pass. However, if the toner container identification 12*p* formed in the cap 12 is removed, it might be possible to attach the toner container 10 to such an image forming apparatus with no proper container identifier.

It should be reminded here that the toner container identification 12*p* is contiguous with said one of the pressing chips 12*k*, and the width of the toner container identification 12*p* in the circumferential direction is greater than the width of said one of the pressing chips 12*k* in the circumferential direction. Accordingly, if the toner container identification 12*p* is removed from the cap 12, then said one of the pressing chips 12*k*, which had already been partially separated from the cap 12 at its side edges via the cut grooves 12*h*, will be completely removed from the cap 12 together with the toner container identification 12*p*. Note, the toner container identification 12*p* is formed by denting one part of the circumferential wall of the cap 12 so that the outer surface of the toner container identification 12*p* radially protrudes further toward the outside as compared to the circumferential wall of the other part of the cap 12. For this reason, removal of the toner container identification 12*p* from the cap 12 would create a hole as large as the toner container identification 12*p* in the circumferential wall of the cap 12.

Figure 9:
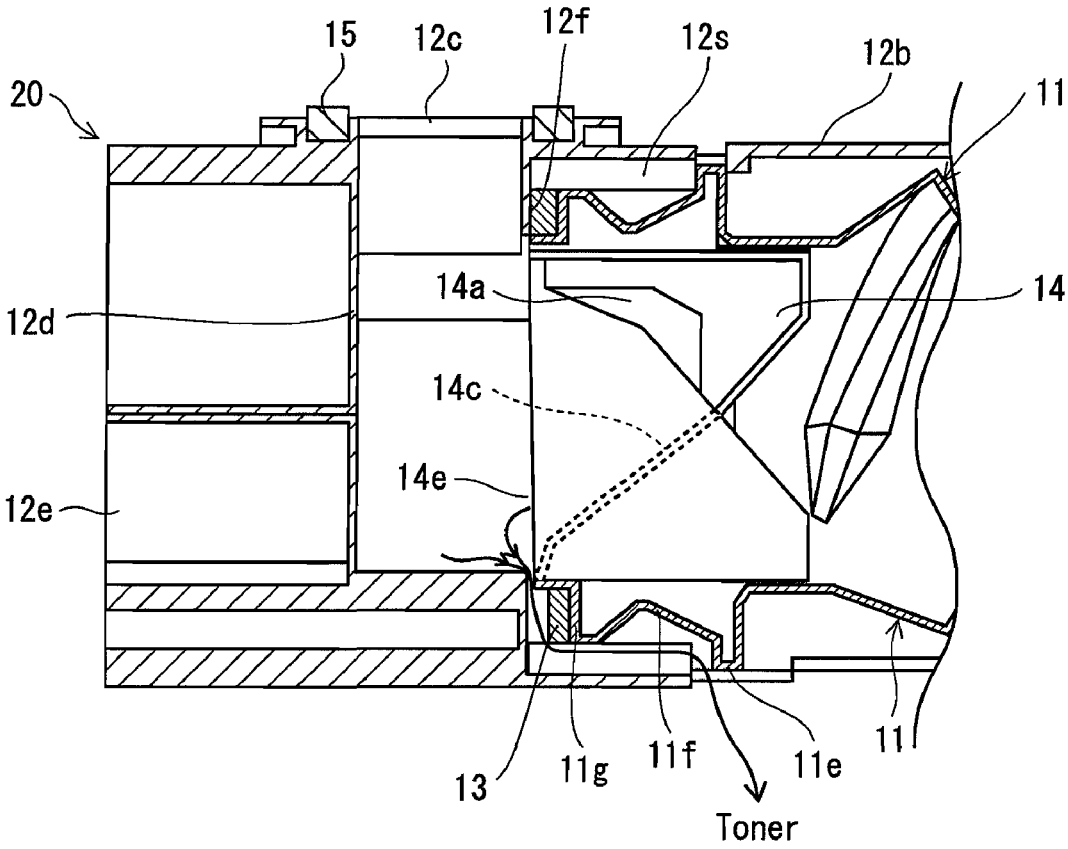
FIG. 9 is a diagram for explaining the behavior of the toner container, the diagram showing a cross-sectional view of a part of the toner container where the cap has been attached to the tip of the first end of the container body.

Once said one of the pressing chips 12*k* has been removed from the cap 12, the pressure applied to the stretchable member 11*f* by the pressing chips 12*k* is released as shown in FIG. 9. This weakens the level of pressure applied to the pressure-seal portion 12*f* by the seal member 13, thus failing to sustain sealing properties of the seal member 13 for sealing the tip of the first end of the container body 11. As a result, the toner in the container body 11 leaks to the outside via the openings 12 and scatters around the toner container 10.

Assume a case where the width of the toner container identification 12*p* in the circumferential direction is not greater than the width of said one of the pressing chips 12*k* in the circumferential direction. In this case, even if the toner container identification 12*p* is removed, said one of the pressing chips 12*k* remains held/supported by the circumferential wall of the cap 12 at a rear edge thereof, the rear edge being an edge of said one of the pressing chips 12*k* that is closer to the tip of the second end of the cap 12 than any other edges thereof is. However, in this case, said one of the pressing chips 12*k* is subjected to (i) an elastic force of the seal member 13 and (ii) an extending force exerted by the compressed stretchable member 11*f*. Consequently, the rear edge of said one of the pressing chips 12*k*, which is connected with the circumferential wall of the cap 12, gradually becomes unable to tolerate such forces, and is ultimately damaged. Accordingly, in this case again, said one of the pressing chips 12*k* is removed from the cap 12, causing the toner to leak to the outside.

As set forth above, it is not easy to attach, to an image forming apparatus, such a toner container 10 from which the toner leaks. If such a toner container 10 is forcefully attached to the image forming apparatus, the inside of the image forming apparatus will be contaminated by the toner. This makes it impossible for the image forming apparatus to produce desired images. Furthermore, scattering of toner inside the image forming apparatus could cause significant damage to the development unit and other structural components, as well as mechanical failures of the image forming apparatus. The above problems can be addressed by the toner container 10 of the present embodiment, which can prevent itself from being attached to and used in an image forming apparatus that cannot compatibly use toner stored in the container body 11 of the toner container 10.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

INDUSTRIAL APPLICABILITY

A toner container of the present invention supplies toner to a development unit while being attached to an image forming apparatus. The toner container of the present invention can prevent itself from being attached to and used in an image forming apparatus that cannot compatibly use toner stored in itself.

What is claimed is:

1. A toner container comprising:

a hollow cylindrical container body that has a container body opening in one end thereof and stores toner therein;

a hollow cylindrical cap that has a cap opening in one end thereof and is rotatably engaged with the container body by the one end of the container body being inserted into the cap opening; and a ring-shaped seal member that is disposed along an outer circumference of the container body opening and forms a seal between the container body and the cap, wherein the cap includes:

a pressure-seal portion to which the seal member is to be pressure-sealed, the pressure-seal portion being disposed inside the cap;

one or more pressing chips that (i) are respectively formed in different areas of a circumferential wall of the cap and (ii) due to the cap being engaged with the container body, latch with the container body in such a manner that a front edge of each of the pressing chips applies pressure to the container body to cause the seal member to be pressure-sealed to the pressure-seal portion, the front edge of each of the pressing chips being closer to the other end of the cap than any other edge thereof is, and being slidable across the container body in a circumferential direction; and a toner container identification that is formed by denting one part of the circumferential wall of the cap, which is contiguous with a rear edge of one of the pressing chips, in such a manner that (i) an outer surface of the toner container identification radially protrudes further outward than an outer surface of the other part of the circumferential wall of the cap, and (ii) the toner container identification has a predetermined cross-section, the rear edge of the one of the pressing chips being an opposite edge of the front edge thereof, and the toner container identification is integrated with the one of the pressing chips so that, when the toner container identification is removed from the circumferential wall of the cap, the one of the pressing chips is removed as well.

2. The toner container according to claim 1, wherein the cap further includes, in the circumferential wall thereof:

one or more openings that are respectively adjacent to the front edges of the pressing chips; and one or more pairs of cut grooves that each extend from a corresponding one of the openings in a direction of a rotational axis of the cap, so that each of the pressing chips is adjacent to a corresponding one of the pairs of cut grooves at side edges thereof that are in parallel with the rotational direction, and the one of the pressing chips is directly surrounded by the toner container identification and one of the pairs of cut grooves.

3. The toner container according to claim 2, wherein a width of the toner container identification in the circumferential direction is greater than a width of the one of the pressing chips in the circumferential direction.

4. The toner container according to claim 1, wherein the toner container identification is formed as a dent on an inner surface of the circumferential wall of the cap, the dent extending in a direction of a rotational axis of the cap.

5. The toner container according to claim 1, wherein one edge of the toner container identification reaches an entrance of the cap opening.

6. An image forming apparatus comprising:

a photosensitive part on which an electrostatic latent image is formed;

a development part operable to develop the electrostatic latent image formed on the photosensitive part by using toner; and the toner container of claim 1, operable to supply the toner to the development part.

7. The image forming apparatus according to claim 6, wherein the cap of the toner container further includes, in the circumferential wall thereof:

one or more openings that are respectively adjacent to the front edges of the pressing chips; and one or more pairs of cut grooves that each extend from a corresponding one of the openings in a direction of a rotational axis of the cap, so that each of the pressing chips is adjacent to a corresponding one of the pairs of cut grooves at side edges thereof that are in parallel with the rotational direction, and the one of the pressing chips is directly surrounded by the toner container identification and one of the pairs of cut grooves.

8. The image forming apparatus according to claim 7, wherein a width of the toner container identification in the circumferential direction is greater than a width of the one of the pressing chips in the circumferential direction.

9. The image forming apparatus according to claim 6, wherein the toner container identification is formed as a dent on an inner surface of the circumferential wall of the cap, the dent extending in a direction of a rotational axis of the cap.

10. The image forming apparatus according to claim 6, wherein one edge of the toner container identification reaches an entrance of the cap opening.

* * * * *